US006467864B1

(12) United States Patent
Cornell

(10) Patent No.: US 6,467,864 B1
(45) Date of Patent: Oct. 22, 2002

(54) DETERMINING MINIMUM ENERGY PULSE CHARACTERISTICS IN AN INK JET PRINT HEAD

(75) Inventor: Robert Wilson Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 188 days.

(21) Appl. No.: 09/634,143

(22) Filed: Aug. 8, 2000

(51) Int. Cl.[7] ..... B41J 2/01

(52) U.S. Cl. ..... 347/14; 347/19; 347/62; 347/64

(58) Field of Search ..... 347/9, 10, 14, 347/19, 61, 62, 64

(56) References Cited

U.S. PATENT DOCUMENTS

| | | | | |
|---|---|---|---|---|
| 4,872,028 A | | 10/1989 | Lloyd | 347/14 |
| 5,177,481 A | | 1/1993 | Ikuta et al. | 341/53 |
| 5,223,853 A | | 6/1993 | Wysocki et al. | 347/14 |
| 5,418,558 A | | 5/1995 | Hock et al. | 347/14 |
| 5,428,376 A | | 6/1995 | Wade et al. | 347/14 |
| 5,519,417 A | | 5/1996 | Stephany et al. | 347/14 |
| 5,581,281 A | | 12/1996 | Fuse | 347/14 |
| 5,600,349 A | | 2/1997 | Keefe | 347/11 |
| 5,682,185 A | | 10/1997 | Wade et al. | 347/19 |
| 5,726,690 A | | 3/1998 | Bohorquez et al. | 347/15 |
| 5,751,302 A | | 5/1998 | Rezanka | 347/9 |
| 6,039,436 A | * | 3/2000 | Andrews et al. | 347/62 |
| 6,139,131 A | | 10/2000 | Prasad et al. | 347/63 |
| 6,315,381 B1 | * | 11/2001 | Wade et al. | 347/19 |

FOREIGN PATENT DOCUMENTS

| | | |
|---|---|---|
| EP | 0649746 A1 | 4/1995 |

* cited by examiner

*Primary Examiner*—Craig A. Hallacher
(74) *Attorney, Agent, or Firm*—Luedeka, Neely & Graham

(57) ABSTRACT

A system provides an optimum energy pulse to a resistive heating element in an ink jet print head. The optimum energy pulse provides an optimal energy density at a surface of the heating element to cause optimal nucleation of ink adjacent the surface of the heating element. The system includes storing in memory values related to heating element dimensions, heating element electrical characteristics, and ink characteristics. Also stored in memory are expressions that provide mathematical relationships between the heating element dimensional values, the heating element electrical values, the ink characteristics, and the amplitude and duration of the optimum energy pulse. The system also includes retrieving from memory the stored values and expressions, and determining, based on the expressions, the amplitude and duration of the optimum energy pulse. The system further generates the optimum energy pulse based on the determined amplitude and duration, and provides the optimum energy pulse to the heating element. The energy density provided by the optimum energy pulse is large enough to cause the ink near the heating element to form a bubble and a droplet, but not so large that energy is wasted which cannot be transferred into the ink after the bubble is formed.

26 Claims, 8 Drawing Sheets

DETERMINING MINIMUM ENERGY PULSE CHARACTERISTICS IN AN INK JET PRINT HEAD

FIELD OF THE INVENTION

The present invention is generally directed to ink jet printing devices. More particularly, the invention is directed to determining optimum characteristics of energy pulses provided to resistive heating elements in an ink jet print head, and to determining optimum characteristics of the resistive heating elements.

BACKGROUND OF THE INVENTION

A thermal ink jet printer forms an image on a print medium by ejecting small droplets of ink from an array of nozzles in an ink jet print head as the print head traverses the print medium. The ink droplets are formed when ink in contact with a resistive heating element is nucleated due to heat produced when a pulse of electrical current flows through the heating element. Typically, there is one resistive heating element corresponding to each nozzle of the array. The activation of any particular resistive heating element is usually controlled by a microprocessor controller in the printer.

Once a bubble of ink begins to form due to heat energy transferred from the heating element into the ink, the ink is thermally isolated from the surface of the heating element. Thus, after the bubble forms, any additional energy provided to the heating element does not transfer into the ink, but is dissipated in the print head heater chip. This results in undesirable overheating of the chip.

One solution to this problem is to provide to the heating element only the minimum amount of energy necessary to nucleate the ink. This requires that the printer controller precisely control characteristics of the energy pulses provided to the heating element. Since the amount of heat energy transferred from the heating element into the ink depends upon characteristics of the ink and characteristics of the heating element, the characteristics of the minimum energy pulse should be determined taking into account the ink and heating element characteristics.

Therefore, a need exists for an ink jet printer that determines characteristics of a minimum energy pulse to be provided to a resistive heating element based on characteristics of the ink and the heating element.

SUMMARY OF THE INVENTION

The foregoing and other needs are met by a system for providing an optimum energy pulse to a resistive heating element in an ink jet print head. The optimum energy pulse generated by the invention provides an optimal energy density at a surface of the resistive heating element to cause optimal nucleation of ink near the surface of the resistive heating element. The system includes (a) storing in memory at least one heating element dimensional value that describes at least one physical dimension of the resistive heating element, (b) storing in memory at least one heating element electrical value that describes at least one electrical characteristic of the resistive heating element, and (c) storing in memory an expression that provides a mathematical relationship between the heating element dimensional value, the heating element electrical value, and a current value representing an optimum value of electrical current flowing through the heating element to generate the optimum energy pulse. The system also includes (d) retrieving from memory the heating element in dimensional value, the heating element electrical value, and the expression, (e) determining, based on the expression, the current value representing the optimum value of electrical current flowing through the heating element to generate the optimum energy pulse, (f) generating the optimum energy pulse corresponding to the value determined in step (e), and (g) providing the optimum energy pulse to the heating element.

In another aspect, the invention provides a system for providing an optimum energy pulse to a resistive heating element covered by a protective overcoat layer in an ink jet print head. The optimum energy pulse generated by the invention provides an optimal energy density at a surface of the resistive heating element to cause optimal nucleation of ink that is adjacent the surface of the protective overcoat layer. The system includes (a) storing in memory at least one protective overcoat dimensional value that describes at least one physical dimension of the protective overcoat, (b) storing in memory at least one heating element electrical value that describes at least one electrical characteristic of the resistive heating element, (c) storing in memory at least one ink-related coefficient that relates to at least one characteristic of the ink, and (d) storing in memory an expression that provides a mathematical relationship between the protective overcoat dimensional value, the heating element electrical value, the ink-related coefficient, and an optimum time duration of the optimum energy pulse. The system also includes (e) retrieving from memory the protective overcoat dimensional value, the heating element electrical value, the ink-related coefficient, and the expression, (f) determining, based on the expression, the optimum time duration of the optimum energy pulse, (g) generating the optimum energy pulse corresponding to the optimum time duration determined in step (f), and (h) providing the optimum energy pulse to the heating element.

Thus, by proper adjustment of the amplitude and duration of the energy pulse provided to the resistive heating elements in the print head, the present invention provides an optimum energy density at the surface of the heating elements. This optimum energy density is just large enough to cause the ink near the heating elements to form a bubble and a droplet. Little or no energy is wasted in excess energy that cannot be transferred into the ink after the bubble is formed. To adjust the amplitude and duration of the energy pulse in providing the optimum energy density, the invention takes into account several factors related to characteristics of the print head, characteristics of the resistive heating elements and the protective overcoat layer, and characteristics of the ink. By storing these factors in memory on the print head and on ink cartridges, and by expressing in mathematical form the relationship between these factors and the optimum pulse energy density, the invention can determine and provide the optimum pulse energy density for practically any combination of ink type and print head design.

In another aspect, the invention provides a system for determining a maximum optimal thickness of a protective overcoat layer covering a print head resistive heating element so that energy is optimally transferred into the adjacent ink. The system is implemented by a computer that includes a processor and a memory. The system includes (a) inputting one or more heating element dimensional values that describe one or more physical dimensions of the resistive heating element, (b) inputting one or more heating element electrical values that describe one or more electrical characteristics of the resistive heating element, (c) inputting one or more ink-related coefficients that relate to one or more characteristics of the ink, (d) inputting one or more print head thermal values relate to a thermal characteristic of the print head. The system also includes (e) retrieving from the memory an expression that provides a mathematical relationship between the one or more heating element dimensional values, the one or more heating element electrical values, the one or more ink-related coefficients, the one or more thermal values, and the maximum optimal thickness of the protective overcoat. The system further includes (f) determining, based on the expression, a thickness value representing the maximum optimal thickness of the protective overcoat.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
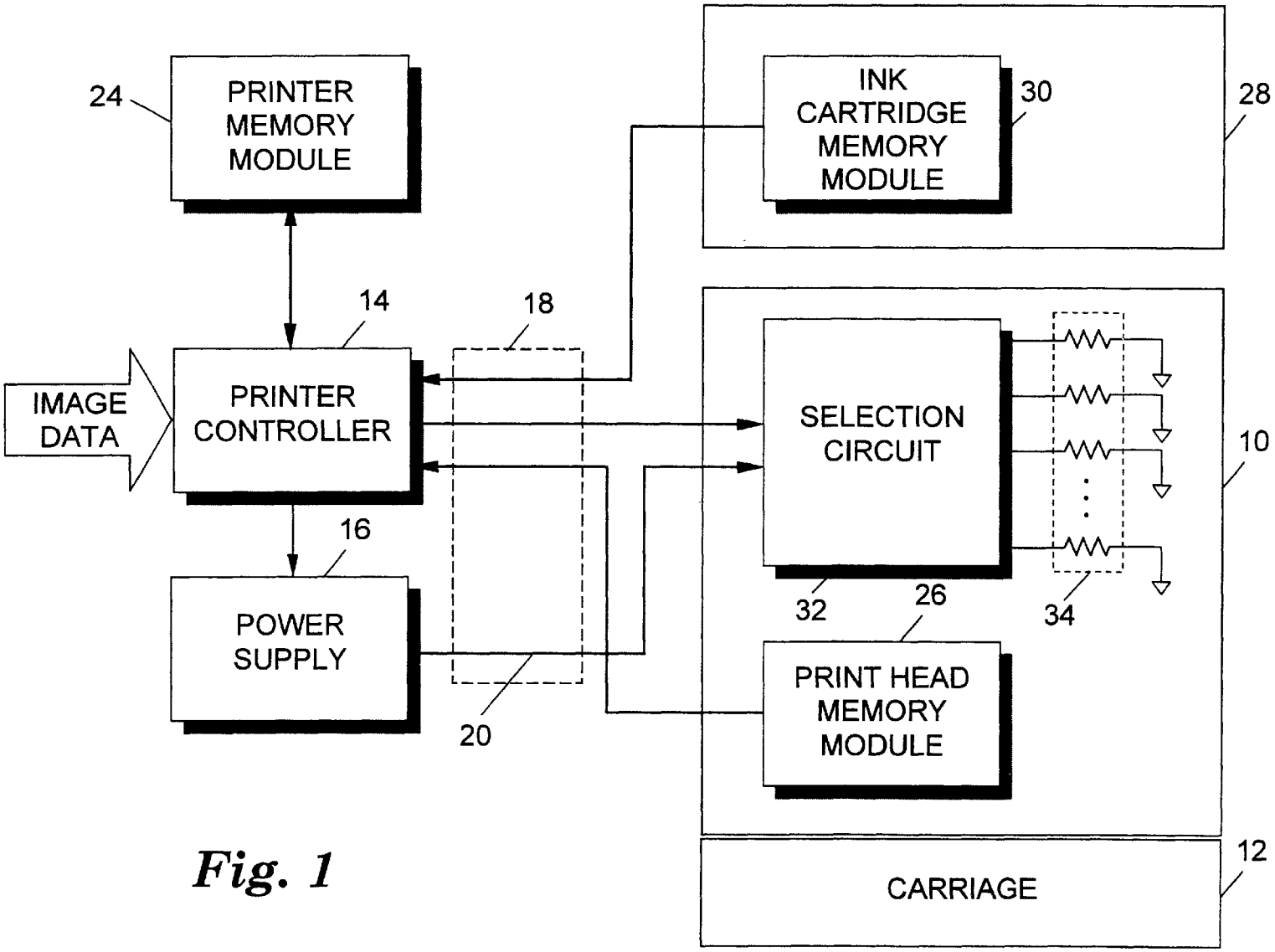
FIG. 1 is a functional block diagram of an ink jet printer according to a preferred embodiment of the invention.

FIG. 1 shows a functional block diagram of a preferred embodiment of an ink jet printer according to the present invention. Preferably, the printer includes a replaceable print head 10 attached to a carriage 12 that provides for translation of the print head 10 across a print medium. When installed in the printer, the print head 10 is electrically connected to a printer controller 14 and a power supply 16. Since the controller 14 and the power supply 16 are preferably in a fixed location in the printer, and are not mounted on the carriage 12, electrical connections between the print head 10 and the controller 14 and power supply 16 are by way of a flexible TAB circuit 18.

As shown in FIG. 1, the controller 14 receives image data from a host computer, and generates control signals based on the image data to control the operation of the print head 10. The controller 14 also controls the power supply 16 to generate a source voltage, $V_s$ on the line 20.

As discussed in more detail below, in the preferred embodiment of the invention, the printer includes a memory module 24 for storing operational parameters and mathematical expressions that are specific to the operation of the printer and/or the print head 10. The print head 10 also preferably includes a memory module 26 for storing parameters that are specific to the print head 10.

Preferably, the ink is stored in a replaceable ink reservoir, such as an ink cartridge 28, that attaches to the print head 10 and rides on the carriage 12. In the preferred embodiment, an ink cartridge memory module 30, such as a nonvolatile random-access memory (NVRAM) device, is attached to the ink cartridge 28. As described in more detail below, the memory module 30 stores parameters related to characteristics of the ink. As shown in FIG. 1, the printer controller 14 is electrically connected to the ink cartridge memory module 30 so that the controller 14 may access memory locations within the module 30.

The print head 10 incorporates a driver circuit 32 that receives the source voltage $V_s$ from the power supply 16 and the control signals from the controller 14. The driver circuit 32 decodes the control signals, and selectively generates voltage pulses across one or more resistive heating elements 34 based on the control signals and $V_s$. A voltage pulse across a heating element 34 causes flow of an electrical current through the resistive material of the heating element 34. The flow of electrical current causes the heating element 34 to dissipate power in the form of heat. When the amplitude and width of the voltage pulse is sufficient to generate a certain minimum energy density on the surface of the heating element 34, the heat dissipated by the heating element 34 causes nucleation of the ink that contacts the surface of the heating element 34. The nucleation of the ink forms a bubble which causes a droplet of ink to be expelled from an adjacent nozzle.

Figure 2A:
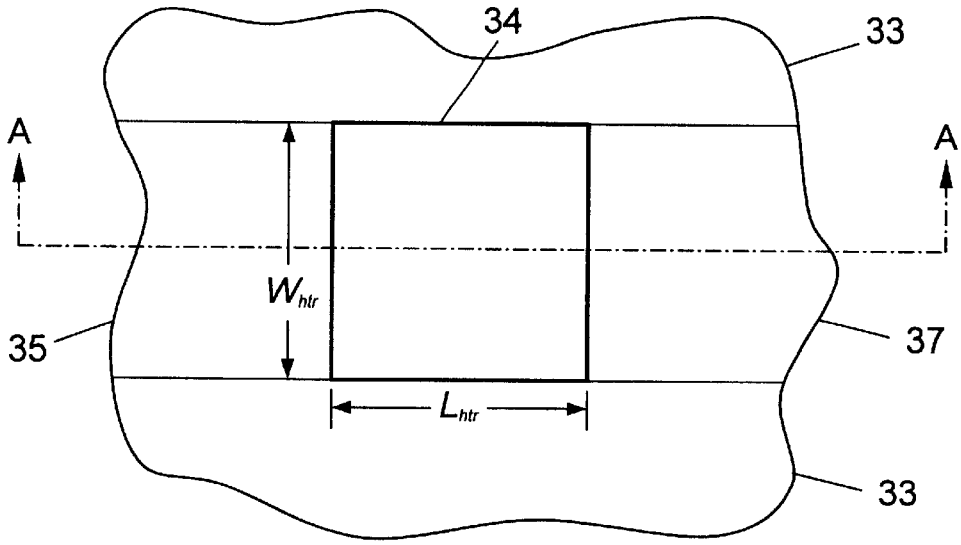
FIGS. 2A and 2B depict an elevation view and a cross-sectional view of a resistive heating element on an ink jet heater chip substrate according to a preferred embodiment of the invention.
Figure 2B:
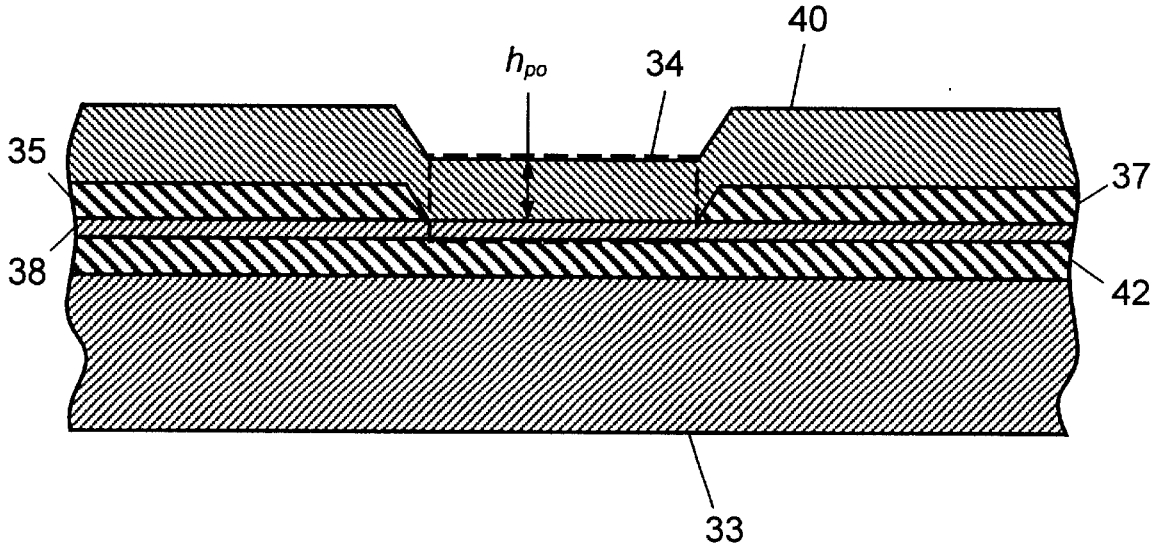

In the preferred embodiment, each heating element 34 is generally rectangular in shape, as shown in FIG. 2A. Thus, each element 34 has a width and a length, also referred to herein as $W_{htr}$ and $L_{htr}$, respectively. As shown in FIG. 2B, which is a cross-sectional view taken at the section line A—A in FIG. 2A, each heating element 34 consists of a resistive layer 38 covered by a protective overcoat 40. The resistive layer 38 is generally Tantalum Aluminum (TaAl), or Tantalum Nitride (TaN), or Hafnium Diboride ($HfB_2$), or some other suitable material with high resistivity and a tolerance for high temperatures. To protect the resistive layer 38 from the corrosive effects of the ink and the cavitation effects of the collapsing vapor bubble, it is generally required to cover the resistive layer 38 with a composite stack of thin films, including Silicon Nitride (SiN), Silicon Carbide (SiC), and Tantalum (Ta) films. The SiN+SiC+Ta composite layer forms the protective overcoat 40. The total thickness, or height, of the SiN+SiC+Ta composite layer which forms the protective overcoat 40 is referred to herein as $h_{po}$.

The resistive layer 38 and the protective overcoat 40 are deposited onto a heater chip substrate 33. The substrate 33 is generally a silicon chip which is 400–800 microns thick with a 1.0–3.0 micron thick top layer 42 of thermally insulating material, such as Silicon Dioxide ($SiO_2$), Boron Phosphorus Doped Glass (BPSG), Phosphorus Doped Glass (PSG), or Spun-on Glass (SOG). Because the thermal diffusivity of silicon is approximately 600 times greater than that of ink, the purpose of the thermal insulating layer 42 is to prevent thermal energy from diffusing into the silicon substrate 33 during the time when current is flowing through the resistive layer 38.

As shown in FIGS. 2A and 2B, one edge of the element 34 is preferably electrically connected to a conductive trace 35. The other end of the conductive trace 35 is connected to a switching device, such as a power FET. The switching device is preferably also disposed on the substrate 33. The other end of the switching device is preferably connected to ground. In the preferred embodiment, the other edge of the heating element 34 is electrically connected to a conductive trace 37, which connects the heating element 34 to a voltage source. In operation, when the switching device is activated, a current flows from the voltage source to ground through the conductive traces 35 and 37 and the heating element 34. In an alternative embodiment, the switching device and conductive trace 35 are connected to the voltage source, and conductive trace 37 is connected to ground.

The conductive traces 35 and 37 are generally made from Aluminum (Al), Aluminum Copper (AlCu), Aluminum Silicon (AlSi), or some other low resistivity aluminum alloy. Since ink is corrosive to aluminum, the conductive traces 35 and 37 are typically covered with the same SiN+SiC+Ta protective layer as that covering the heater 34.

Generally, the energy density, $ED_{htr}$, provided to the surface of the heating element 34 is given by:

$$ED_{htr} = \frac{P_{htr} \times t_{pw}}{A_{htr}}, \tag{1}$$

where $P_{htr}$ is the power of the energy pulse provided to the heating element 34, $t_{pw}$ is the pulse width of the pulse in units of time, and $A_{htr}$ is the area of the heating element 34.

The power of the energy pulse provided to the heating element 34 may be expressed as:

$$P_{htr} = \frac{V_{htr}^2}{R_{htr}}, \tag{2}$$

where $V_{htr}$ is the voltage amplitude of the pulse across the heating element 34 and $R_{htr}$ is the resistance of the heating element 34. Based on equations (1) and (2), $ED_{htr}$ may be expressed as:

$$ED_{htr} = \frac{V_{htr}^2}{A_{htr} R_{htr}} \times t_{pw}. \tag{3}$$

Thus, during operation of the printer, the energy density at the surface of the heating element 34, $ED_{htr}$, may be adjusted by adjusting the amplitude and/or the pulse width of the voltage pulse provided by the driver circuit 32 to the heating element 34.

Figure 3:
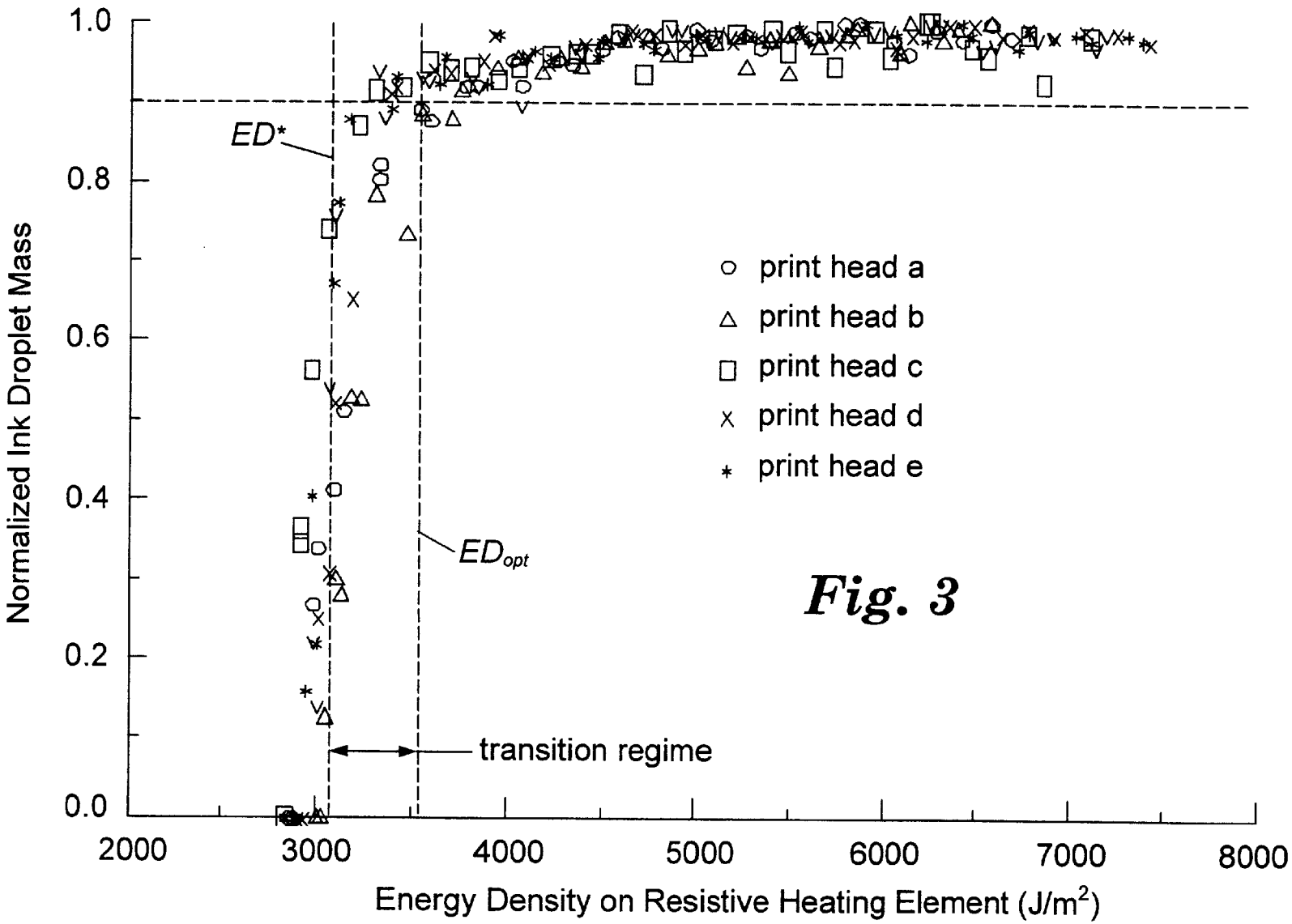
FIG. 3 is a plot of a typical response curve indicating normalized droplet mass as a function of energy density on the surface of a resistive heating element.

When the energy density, $ED_{htr}$, at the surface of the heating element 34 is large enough, an ink bubble forms which causes a droplet of ink to separate from the surface of the element 34. FIG. 3 shows a typical response curve indicating normalized mass of the ink droplet as a function of the energy density, $ED_{htr}$, provided to the surface of the heating element 34. The data points plotted in FIG. 3 were measured using five different print heads (a–e), all having heating elements 34 with individual areas of 1056 $\mu m^2$. It has been determined that this type of response also applies to heating elements 34 having areas ranging from 300 $\mu m^2$ to 2300 $\mu m^2$. The binary nature of this response is due to the heat transfer and ink bubble nucleation process. During the time $t_{pw}$ that the voltage pulse is applied to the heating element 34, heat is transferred from the surface of the heating element 34 into the ink. When the ink at the surface of the element 34 reaches the superheat limit, it explodes into vapor, and the ink bubble grows. During the bubble growth phase, there is an insulating layer of water vapor that prevents further transfer of heat into the ink. Because the ink is thermally isolated from the surface of the heating element 34 by the bubble, all of the latent heat needed for the phase change process must come from thermal energy stored in the ink prior to nucleation. After nucleation, additional energy provided to the heating element 34 does not transfer into the ink. Thus, the "knee" of the response shown in FIG. 3 indicates the minimum energy density at which nucleation of the ink generally occurs. Since it is optimally desirable to provide no more energy to the heating element 34 than necessary to nucleate the ink, the minimum energy density as indicated in FIG. 1 is also referred to herein as the optimum energy density, $ED_{opt}$.

Thus, it is desirable to operate the print head 10 to provide the optimum energy density, $ED_{opt}$, at the surface of the heating element 34 by proper adjustment of the amplitude and duration of the energy pulse provided to the element 34. The adjustment of the amplitude and duration of the energy pulse to provide the optimum energy density, $ED_{opt}$, requires taking into account several factors related to characteristics of the print head 10, characteristics of the heating element 34, and characteristics of the ink. If these factors are known, and their interrelationships are understood, then $ED_{opt}$ may be determined and controlled for practically any combination of ink type and print head heater chip design.

Based on experiments performed using heating elements 34 of varying thickness, and based on finite element heat transfer modeling of the experimental results, a set of regression equations have been determined that define relationships between the several variables affecting the optimum energy density, $ED_{opt}$. These regression equations are set forth below.

$$ED_{opt} = b_2 + b_3 h_{po} + b_4(22 + \Delta T) + \frac{b_5}{PD \times 10^{-9}} \tag{4}$$

$$t_{opt} = \frac{ED_{opt}}{PD} \tag{5}$$

$$i_{opt} = W_{htr}\sqrt{\frac{PD}{R_s}} \tag{6}$$

$$h_{max} = \frac{1}{b^3}\left\{\frac{b_1 R_s \Delta T}{R_x W_{htr}^2 + R_s L_{htr} W_{htr}} - \left[b_2 + b_4(22 + \Delta T) + \frac{b_5}{PD \times 10^{-9}}\right]\right\} \tag{7}$$

In the above equations:

$ED_{opt}$ is the optimum energy density at the surface of the heating element 34 (Joules/$m^2$);

$b_2$, $b_3$, $b_4$, and $b_5$ are ink-related coefficients;

$h_{po}$ is the thickness of the protective overcoat of the heating element 34 (microns);

$\Delta T$ is a print head offset temperature value (centigrade);

PD is the heating element power density (watts/$m^2$);

$t_{op}$ is the optimum time duration (pulse width) of the energy pulse (seconds);

$i_{opt}$ is the amplitude of electrical current flowing through the heating element 34 to generate the energy pulse (amperes);

$W_{htr}$ is the width of the heating element 34 (meters);

$R_s$ is the resistivity of the resistive layer 38 of the heating element 34; (This is also referred to as the sheet resistance, and it has units of ohms per square. The DC resistance of the heater is simply determined by multiplying the resistivity (or sheet resistance) $R_s$ times the $L_{htr}/W_{htr}$ ratio.)

$h_{max}$ is the maximum optimal thickness of the protective overcoat 40 (microns);

$R_x$ is the total resistance of the power switching device 35 and metal traces (such as the trace 37) in series with the heating element 34 (ohms);

$L_{htr}$ is the length of the heating element 34 (meters); and $b_1$ is a coefficient related to the mass of the ink droplets and the firing frequency of the print head 10. Further explanation of, and exemplary values of these variables is provided in the following discussion.

With reference to FIG. 3, the optimal energy density operating point $ED_{opt}$ is identified at the knee of the curve. Another point of thermodynamic interest is the beginning of vapor embryo formation (i.e. nucleation onset), which is identified in FIG. 3 as ED*. This is the point where some vapor embryos are beginning to appear on the heater surface, and they have not yet merged together into a single, homogeneous bubble. This point is of interest because it identifies the time required (i.e. t*=ED*/PD) to bring about the onset of vapor embryo formation.

Figure 4:
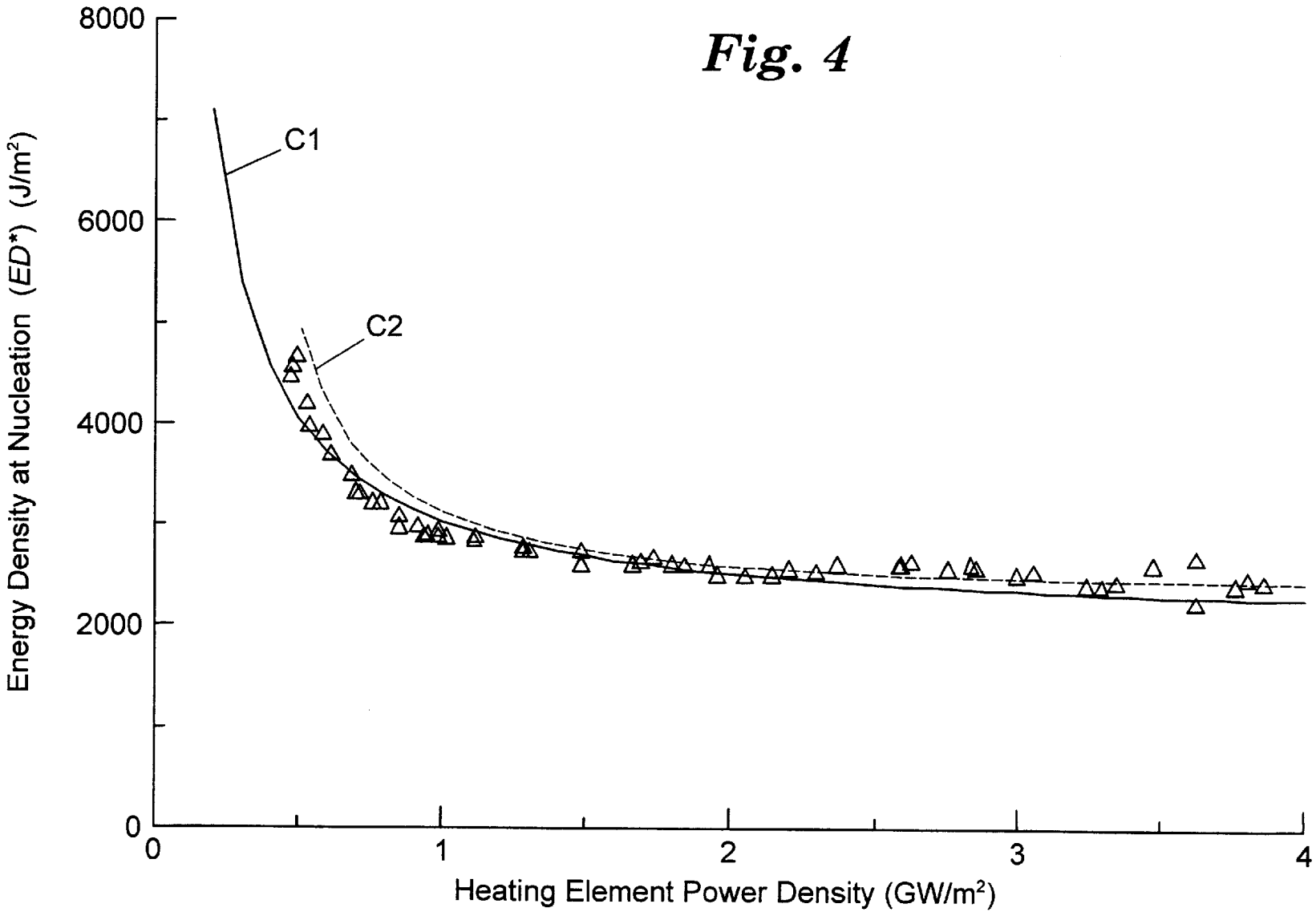
FIG. 4 is a plot of a regression equation for energy density at nucleation as a function of heating element power density compared to a finite element heat transfer model and experimental data points.

Another piece of information may be gleaned by plotting ED* versus PD, as shown in FIG. 4. The curved region identifies the time during which the thermal wave begins to propagate through the thermal insulation layer 42. In the region above 1.5 GW/m$^2$, the heating rates are exceedingly high. These high heating rates cause the superheat limit to be reached before the thermal wave has had time to propagate through the insulation layer 42 which separates the resistive layer 38 from the substrate 33. In the high power density regime, the ED* versus PD response is nearly flat, thereby indicating that little to no thermal energy is escaping into the silicon 33 through the insulation layer 42. This is a very desirable condition because once the thermal wave has penetrated the insulation layer 42, the primary heat conduction path shifts from the ink side of the device to the silicon side of the device. As stated previously, the thermal diffusivity of silicon is approximately 600 times greater than that of water, so it is important to size the thermal insulation layer 42 judiciously.

Also shown in FIG. 4 is the response in the low power density regime. In the low power density regime, the energy density at nucleation begins to grow exponentially because the long pulse times associated with low power density permit the thermal wave to penetrate the insulation layer 42 and diffuse into the silicon substrate 33.

Again, using a combination of regression analysis on experimental data and finite element modeling, it was found that the following expression predicts ED*.

$$ED^* = a_1 + a_2 h_{po} + a_3(22 + \Delta T) + \frac{a_4}{PD \times 10^{-9}}, \tag{4a}$$

where $a_1$, $a_2$, $a_3$, and $a_4$ are ink-specific coefficients;

$\Delta T$, PD, and $h_{po}$ are as identified previously; and

ED* is the heater energy density at the film boiling onset (J/m$^2$).

Typical values for $a_1$, $a_2$, $a_3$, and $a_4$ are listed in Table I below.

TABLE I

| Coefficient | Pigment-based Ink | Dye-based Ink |
|---|---|---|
| $\alpha_1$ | 729 | 233 |
| $\alpha_2$ | 1212 | 1034 |
| $\alpha_3$ | −8.54 | −6.74 |
| $\alpha_4$ | 1020 | 924 |

A typical correlation between the experimental results, the two dimensional finite element heat transfer modeling, and equation (4a) is shown in FIG. 4. This particular set of experimental results was obtained using a heating element 34 having a length and width of 29.5 microns, and pigment-based ink. Curve C1 of FIG. 4 corresponds to equation (4a), curve C2 to the heat transfer model, and the triangle symbols (A) correspond to the measured experimental data points. For the curve C1, the following values were used in equation (4a): $a_1$=729, $a_2$=1212, $a_3$=−8.54, $a_4$=1020, $\Delta T$=0, and $h_{po}$= 0.26 $\mu$m (SiN)+0.43 $\mu$m (SiC)+0.52 $\mu$m (Ta).

As discussed previously, the invention determines $ED_{opt}$ because that identifies how the heater is pulsed in operation. The ED* point, however, is more esoteric in nature, since the print head will not be operated at this point in the product. For these reasons, the coefficients $a_1$, $a_2$, $a_3$, and $a_4$ are not stored in the memory modules of the is preferred embodiment.

In general, the reason that ink-specific coefficients ($a_n$, $b_n$) differ for pigment-based ink and dye-based ink is that during the high pressure phase of the bubble growth process, the bubble wall experiences an acceleration on the order of one million times the gravitational pull of the earth. This is not a problem for dye-based inks, but pigment-based inks have colorant particles of a finite size. Pigment particles are held in solution with a delicate balance of the electrochemical forces between water, dispersant, pigment, and humectant. These weak forces are not sufficient to hold the pigment particles in solution under high accelerations. During the high-pressure/high-acceleration phase of the bubble growth process, some of these particles are stripped from the ink and left on top of the heater surface. This layer of pigment sludge acts as a thermal insulation between the liquid ink and the heating element 34. This thickness builds up to a steady state layer very rapidly (usually within the first couple hundred thousand fires). The collapsing bubble tends to scrub off the pigment layer. The scrubbing action of the collapsing bubble opposes the stripping action of the accelerating bubble wall to keep the pigment layer from building without limit.

Based on equations (4) and (5), the optimum pulse width, $t_{op}$, may be expressed as:

$$t_{opt} = \frac{b_2 + b_3 h_{po} + b_4(22 + \Delta T) + \frac{b_5}{PD \times 10^{-9}}}{PD}. \tag{8}$$

Generally, the resistance of the heating element 34, $R_{htr}$, may be expressed as:

$$R_{htr} = R_s \times \frac{L_{htr}}{W_{htr}}. \tag{9}$$

Based on equations (6) and (9), the optimum voltage level of the energy pulse is expressed as:

$$V_{opt}=i_{opt}\times R_{htr}, \tag{10}$$

or $$V_{opt} = L_{htr} \times \sqrt{PD \times R_s}\,. \tag{11}$$

Since resistance is introduced by the driver circuit 32, by the electrical connections in the TAB circuit between the power supply 16 and the driver circuit 32, and by the electrical connections between the driver circuit 32 and the heating elements 34, there is a voltage drop between the power supply 16 and the heating elements 34. Thus, the optimum voltage, $V_{opt}$, across the heating element 34 is not equivalent to the source voltage, $V_s$. Taking into account the total resistance between the power supply 16 and the heating elements 34, referred to herein as $R_d$, the value of the supply voltage, $V_s$, needed to provide $V_{opt}$ across the heating element 34 may be expressed according to:

$$V_s = V_{opt} \times \frac{R_{htr} + R_d}{R_{htr}} = V_{opt} \times \left(\frac{R_d}{R_{htr}} + 1\right) = V_{opt} \times \left(\frac{R_d W_{htr}}{R_s L_{htr}} + 1\right). \tag{12}$$

Based on equations (11) and (12), the optimum value of $V_s$ is expressed according to:

$$V_s = L_{htr} \times \sqrt{PD \times R_s} \times \left(\frac{R_d W_{htr}}{R_s L_{htr}} + 1\right). \tag{13}$$

Based on equations (8) and (13), the printer controller 14 adjusts the pulse width, $t_{opt}$, and/or the supply voltage, $V_s$, to obtain the optimum energy density, $ED_{opt}$, for any combination of ink and heater chip, based on values for the variables listed above. According to the invention, these values are stored in either the print head memory module 26 or in the ink cartridge memory module 30. In the preferred embodiment of the invention, the coefficients $b_1$, $b_2$, $b_3$, $b_4$, and $b_5$, heating element dimensional values $h_{po}$, $W_{htr}$, and $L_{htr}$, the heating element power density PD, the logic switching device resistance $R_x$, and the resistivity of the heating element 34 $R_s$, are stored in the print head memory module 26. The print head operating point offset temperature $\Delta T$ is preferably stored in the ink cartridge memory module 30. An ink identifier, which identifies the type of ink in the ink cartridge 28, is also preferably stored in the ink cartridge memory module 30.

Preferably, the regression equations listed above are stored in the printer memory module 24. As described in more detail below, the printer controller 14 retrieves the equations from the memory module 24, retrieves the variable values from the ink cartridge memory module 30 and the print head memory module 26, and determines optimum values for the pulse width, $t_{opt}$, and the current, i, based thereon.

Figure 5:
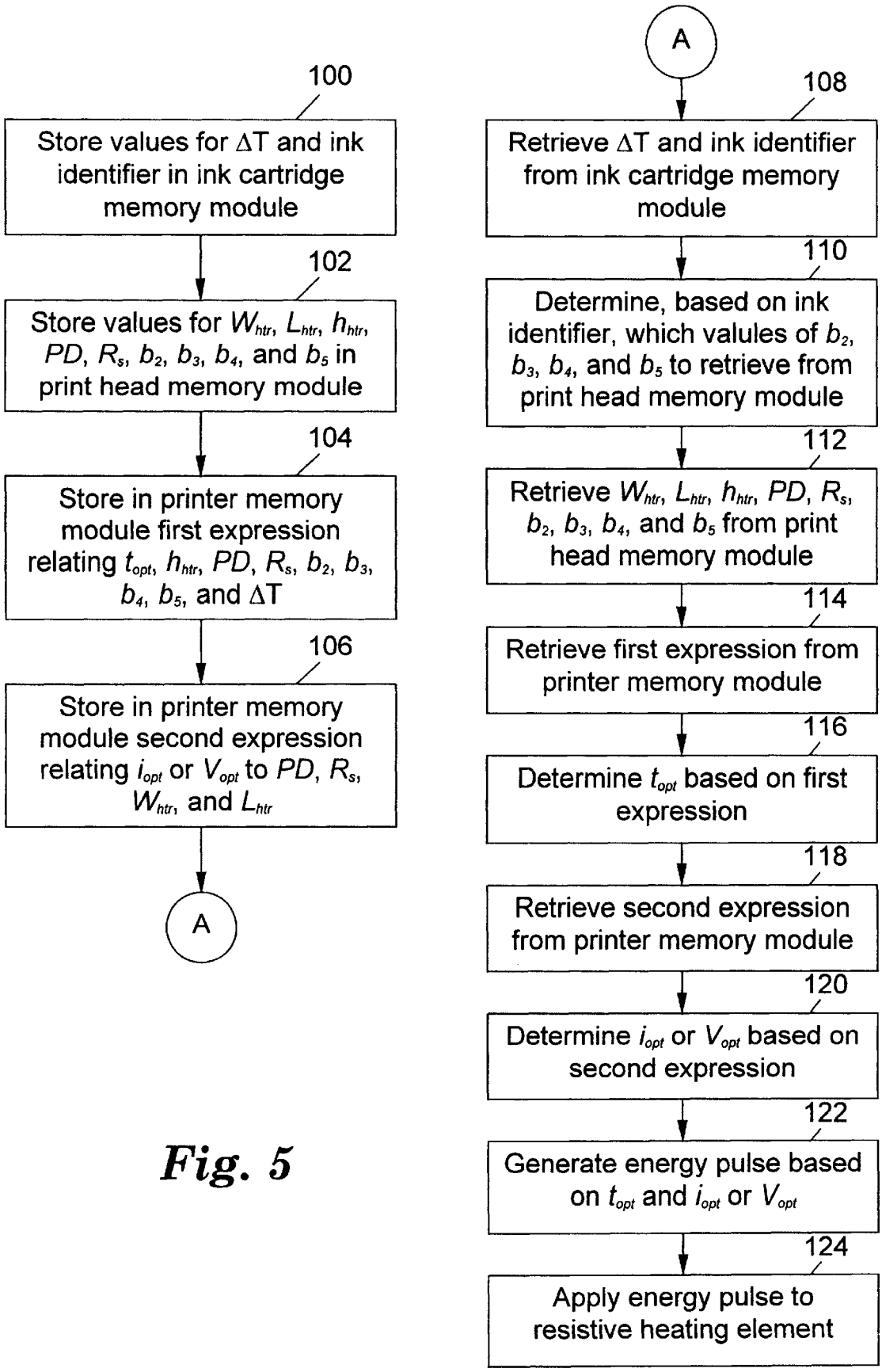
FIG. 5 depicts a flow chart of a system for determining the optimum characteristics of an energy pulse to be applied to a resistive heating element according to a preferred embodiment of the invention.

Operation of a preferred embodiment of the invention will now be described with reference to FIG. 1 and the flow chart depicted in FIG. 5. Preferably, during the manufacture of the ink cartridge 28, values for the ink identifier and the print head operating point offset temperature, $\Delta T$, are stored in the ink cartridge memory module 30 (step 100). For example, the ink identifier may have a value of 0 to indicate that pigment-based ink is loaded in the cartridge, or a value of 1 to indicate dye-based ink. A typical range for $\Delta T$ is between 10° C. and 40° C.

During or subsequent to manufacture of the print head 10, values for $W_{htr}$, $L_{htr}$, $h_{po}$, PD, $R_s$, $b_2$, $b_3$, $b_4$, and $b_5$ are stored in the print head memory module 26 (step 102). Typical values for the heating element length, width, and thickness dimensions, $W_{htr}$, $L_{htr}$, and $h_{po}$, are 29.5 $\mu$m, 29.5 $\mu$m, and 1.21 $\mu$m, respectively. A typical value for the resistivity of a heating element 34 having a TaAl resistive layer 38 is 28.2 Ω/square. A typical value for the power density, PD, is 2.5 $GW/m^2$. In the preferred embodiment, two sets of values for the ink-related coefficients, $b_2$, $b_3$, $b_4$, and $b_5$ are stored: one set for dye-based ink and another set for pigment-based ink. Typical values of these coefficients are listed in Table II.

TABLE II

| Coefficient | Pigment-based Ink | Dye-based Ink |
|---|---|---|
| $b_2$ | 502.6 | −13.97 |
| $b_3$ | 2050.2 | 1997.2 |
| $b_4$ | −16.337 | −17.93 |
| $b_5$ | 2905.8 | 3663.1 |

During manufacture of the printer, or at a printer maintenance period thereafter, a firmware module for calculating $t_{opt}$ according to equation (8) is stored in the printer memory module 24 (step 104). A firmware module for calculating $i_{opt}$ or $V_{opt}$ according to equation (6) or (11) is also stored in the printer memory module 24 (step 106).

In the preferred embodiment, when the printer is powered on, the printer controller 14 accesses the ink cartridge memory module 30 and retrieves the values for the ink identifier and $\Delta T$ (step 108). Based on the value of the ink identifier, i.e. 1 or 0, the controller 14 determines which values of $b_2$, $b_3$, $b_4$, and $b_5$ (Table I) to retrieve from the print head memory module 26 (step 110). The controller 14 then accesses the print head memory module 26 and retrieves the values for $b_2$, $b_3$, $b_4$, $b_5$, $W_{htr}$, $L_{htr}$, $h_{po}$, PD, and $R_s$ (step 112).

Preferably, the controller 14 then retrieves from the printer memory module 24 the firmware module for calculating $t_{opt}$ (step 114), and determines $t_{opt}$ based on the values retrieved at steps 108 and 112 (step 116). For example, for a pigment-based ink, the controller 14 determines $t_{opt}$ according to:

$$t_{opt} = \frac{b_2 + b_3 h_{po} + b_4(22 + \Delta T) + \dfrac{b_5}{PD \times 10^{-9}}}{PD}; \tag{8}$$

$$t_{opt} = \frac{502.6 + (2050.2)(1.21) - (16.337)(22 + 40) + \dfrac{2905.8}{2.5}}{2.5 \times 10^9} = 1.253\ \mu\text{sec}$$

Thus, for this example, the optimum pulse width is 1.253 $\mu$sec.

According to the preferred embodiment of the invention, the controller 14 retrieves from the printer memory module 24 the firmware module for calculating $V_{opt}$ according to equation (11) (step 118), and determines $V_{opt}$ based on the values retrieved at step 112 (step 120). For example, the controller 14 determines $V_{opt}$ according to:

$$V_{opt} = L_{htr} \times \sqrt{PD \times R_s}\,; \tag{11}$$

$$V_{opt} = 29.5 \times 10^{-6} \times \sqrt{2.5 \times 10^9 \times 28.2} = 7.83 \text{ volts.}$$

Based on the value of $V_{opt}$ determined from equation (11), the controller 14 controls the power supply 16 to set the supply voltage, $V_s$, accordingly. Thus, the controller 14 sets the supply voltage according to:

$$V_s = V_{opt} \times \left(\frac{R_d}{R_{htr}} + 1\right) = 7.83 \times \left(\frac{R_d}{28.2} + 1\right) \text{ volts,} \quad (12)$$

where $R_d$ is the total resistance between the power supply 16 and the heating elements 34.

While there are various other actual resistances between the voltage source and ground that go into the total value of $R_d$ in equation (12), the only value that is actually stored in the memory module 26 of the preferred embodiment is the on-resistance of the power FET and the resistance of the power and ground traces 35 and 37 on the substrate 33. Other resistance values, such as cables and interconnects, are external to the print head 10 and are generally very small compared to the components located on the substrate 33. A viable option is to not store the off-chip component values going into the $R_d$ term. However, it will be appreciated that nominal resistance values for the cables and interconnects and other components external to the print head 10 may be stored in the printer memory module 24. These external resistance values may be extracted from the printer memory module 24 and added to the print head resistance values making up the $R_d$ term.

Based on the image data from the host computer, the printer controller 14 controls the driver circuit 32 to selectively provide energy pulses to the heating elements 34, where the energy pulses have a voltage amplitude of $V_{opt}$ (7.83 volts) and a pulse width of $t_{opt}$ (1.253 $\mu$sec) (steps 122 and 124).

As firing frequencies of ink jet print heads increase, one of the goals in designing an ink jet print head is to reduce the amount of power dissipated in the print head, and thereby reduce the amount of heat generated by the print head. One of the most practical means of reducing power dissipation is to reduce the amount of energy per pulse required to properly eject a droplet of ink. Thus, one design goal is to push the knee of the response curve of FIG. 3 to the left. This is accomplished by using thinner films in the formation of the heating elements 34.

In the preferred embodiment of the invention, the maximum thickness of the SiN+SiC+Ta protective layer 40 of the heating element 34 is determined according to equation (7):

$$h_{max} = \frac{1}{b_3}\left\{\frac{b_1 R_s \Delta T}{R_x W_{htr}^2 + R_s L_{htr} W_{htr}} - \left[b_2 + b_4(22 + \Delta T) + \frac{b_5}{PD \times 10^{-9}}\right]\right\}, \quad (7)$$

where $b_1$ is an empirically-determined coefficient, the value of which depends upon the firing frequency of the print head and the nominal mass of the ink droplets produced by the print head.

The ink coefficient $b_1$ is dependent on the heat dissipation mechanism of the print head 10. Most of the heat is carried away by convection (i.e. by the mass flow of ink through the device). In other words, as print density increases, so does input power, but so does the mass flow rate of ink. As the liquid ink passes the silicon chip on its way to the paper, it picks up thermal energy by convection. When the ink is jetted onto the paper, it leaves the control volume of the chip, taking with it a finite quantity of thermal energy. Since the primary power dissipation mechanism is convection, and convection is dependent on mass flow rate, it is reasonable to assume that there will be a finite difference in the macroscopic heat transfer mechanism from head to head because microscopic droplet mass is expected to vary somewhat from head to head. For this reason, there is a maximum likelihood estimate for $b_1$ and a conservative value for $b_1$. The maximum likelihood estimate assumes a nominal print head that delivers a nominal size droplet of ink (i.e., a nominal mass flow rate). The conservative estimate assumes the droplet mass is at the lowest end of the expected size range, reducing the convection heat transfer mechanism. Similarly, since the mass of the droplets produced by a multi-color print head is generally much less than the mass of the droplets produced by a monochromatic print head, the $b_1$ coefficients for a multi-color head are different than for a monochromatic head because the mass flow rates per Watt are different.

For a single-color print head providing 20% print media coverage at 6.8 pages per minute (PPM) using 28 nanogram ink droplets, the most likely value of $b_1$ is $1.364\times10^{-7}$, and a conservative value is $1.186\times10^{-7}$. For a three-color print head providing 10% print media coverage per color at 2.6 PPM using 7 nanogram ink droplets, the most likely value of $b_1$ is $7.042\times10^{-8}$, and the conservative value is $5.780\times10^{-8}$. $R_x$ in equation (7) is a resistance value that accounts for circuit resistances within the driver circuit 32. For example, $R_x$ includes the source-to-drain resistance of the power FET switching device 35 and the resistance of the associated metal traces within the driver circuit 32 and the ground trace 37. A typical value of $R_x$ is 7.2Ω.

Thus, based on equation (7), a typical value of $h_{max}$ for a mono-color print head 10 using pigment-based ink is determined according to:

$$h_{max} = \frac{1}{2050.2}\left\{\frac{1.364\times10^{-7}\times28.2\times40}{7.2\times(29.5\times10^{-6})^2 + 28.2\times(29.5\times10^{-6})^2} - \left[502.6 - 16.337(22+40) + \frac{2905.8}{2.5}\right]\right\}$$

$$h_{max} = 2.118\ \mu\text{m}.$$

Figure 6:
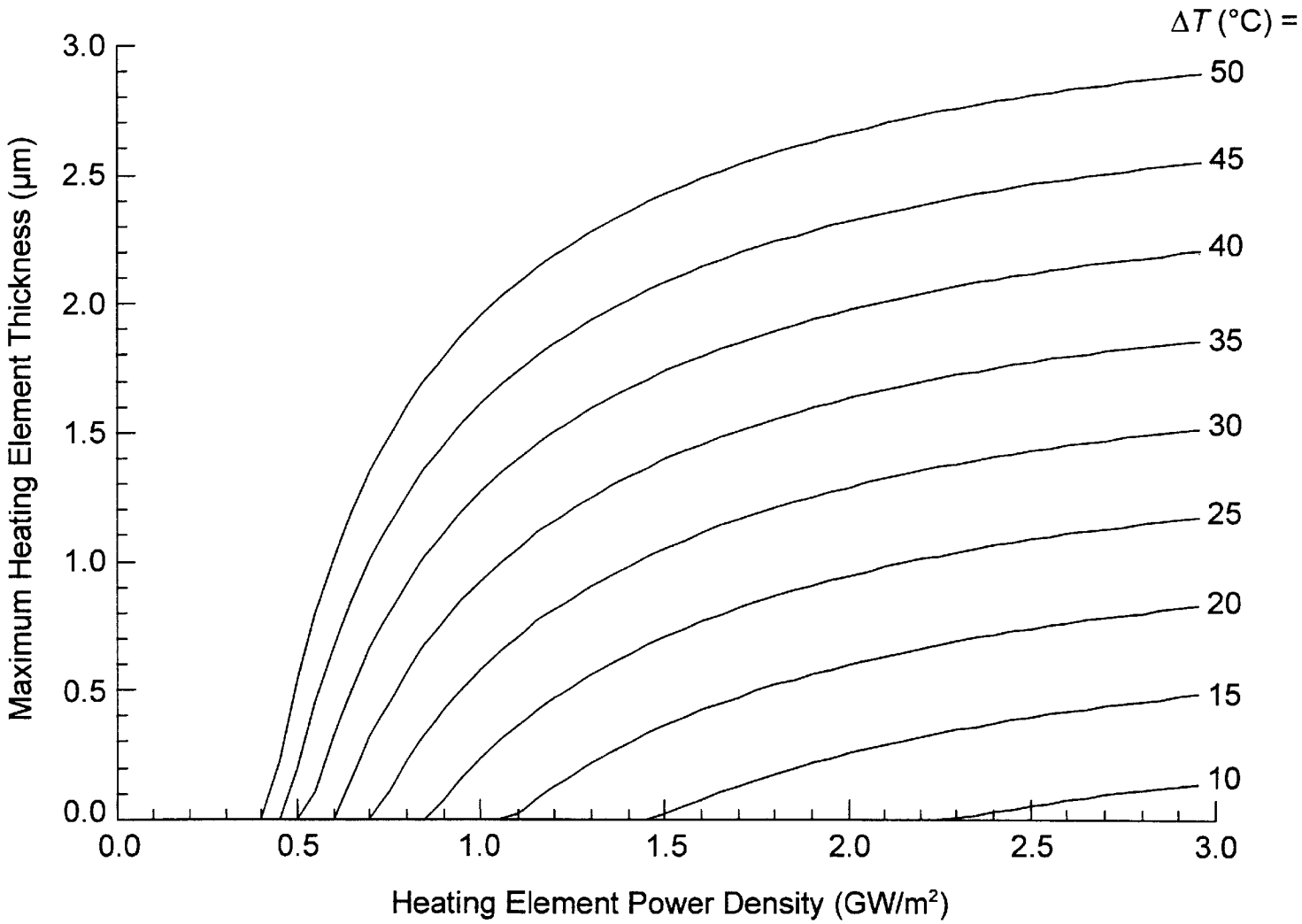
FIGS. 6 and 7 depict exemplary response curves indicating maximum heating element thickness as a function of heating element power density according to a preferred embodiment of the invention.

Shown in FIG. 6 is a plot, based on the relationship of equation (7), showing maximum protective overcoat thickness, $h_{max}$, as a function of heating element power density, PD, for a mono-color print head producing 28 ng pigment-based ink droplets and providing 20% coverage at 6.8 PPM. The various curves plotted in FIG. 6 are for various values of print head offset temperature, ΔT, ranging from 10 to 50° C. The curves of FIG. 6 apply to a print head in which $R_s$ is 28.2 Ω/square, $L_{htr}$ and $W_{htr}$ are 29.5 $\mu$m, and $R_x$ is 7.2Ω.

Figure 7:
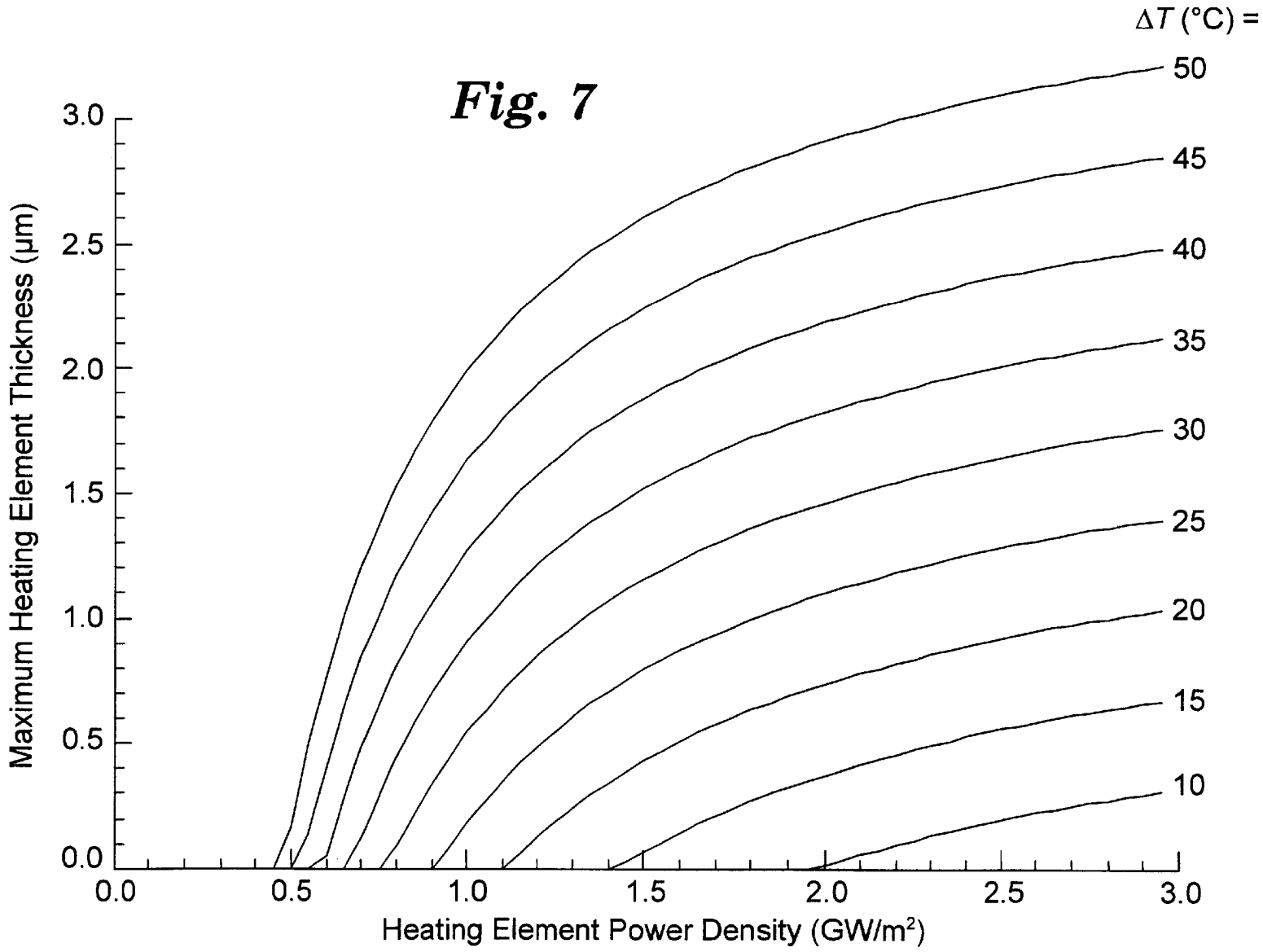

FIG. 7 depicts a plot of $h_{max}$ as a function of PD for a three-color print head producing 7 ng dye-based ink droplets and providing 10% coverage at 2.6 PPM. The curves of FIG. 7 apply to a print head in which $R_s$ is 28.2 Ω/square, $L_{htr}$ is 37.5 $\mu$m, $W_{htr}$ is 14.0 $\mu$m, and $R_x$ is 4.3Ω.

Figure 8:
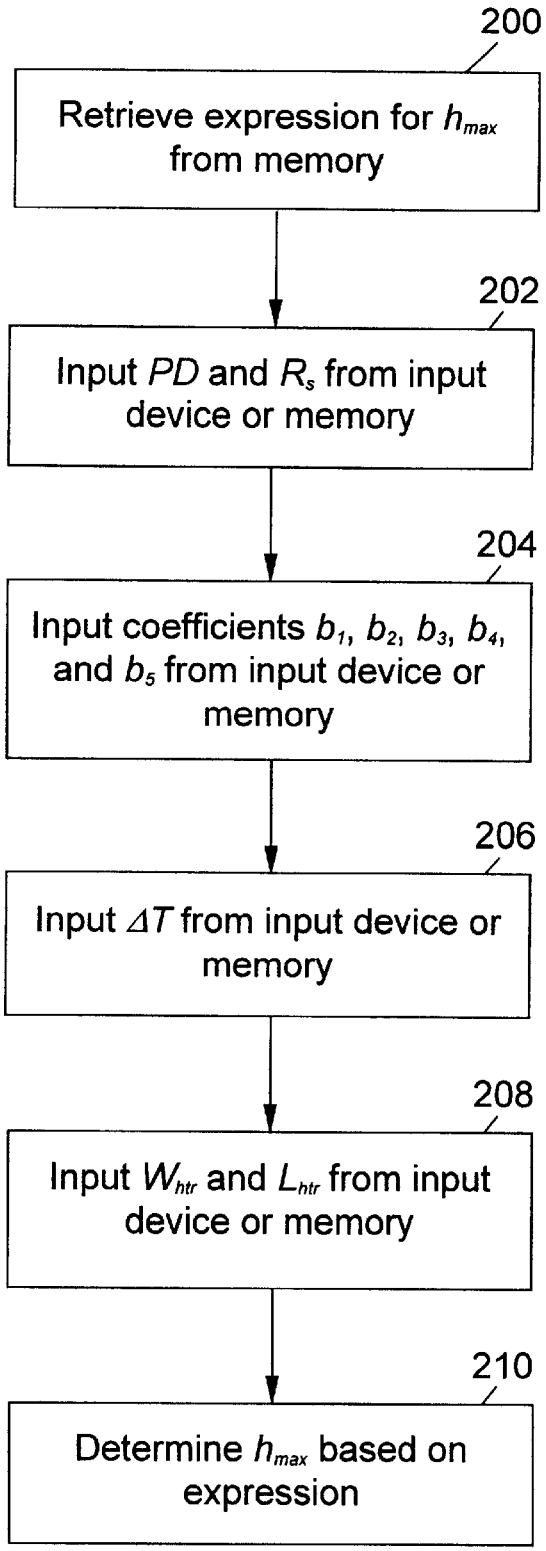
FIG. 8 depicts a flow chart of a system for determining the optimum thickness of a resistive heating element in an ink jet print head according to a preferred embodiment of the invention.

Using the relationship of equation (7), another embodiment of the invention provides a system for determining the maximum overcoat thickness, $h_{max}$, for a particular ink jet print head. Preferably, the system is implemented as a computer algorithm running on a computer processor, such as in a laptop computer, personal computer, or workstation computer. With reference to FIG. 8, when the system is executed, the algorithm representing the relationship of equation (7) is retrieved from computer memory (step 200). Known values for $W_{htr}$ and $L_{htr}$ are input into the algorithm from an input device, such as a keyboard, or from a memory location (step 202). Known values for PD, $R_s$, $b_1$, $b_2$, $b_3$, $b_4$, $b_5$, and ΔT are also input into the algorithm (steps 204, 206, and 208). The system then determines $h_{max}$ based on the relationship of equation (7) and the known values of $W_{htr}$, $L_{htr}$, PD, $R_s$, $b_1$, $b_2$, $b_3$, $b_4$, $b_5$, and $\Delta T$. Preferably, the computed value of $h_{max}$ is then provided to a user by way of an output device, such as a computer monitor or printer.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A system for providing an optimum energy pulse to a resistive heating element in an ink jet print head, whereby the energy pulse provides an optimal energy density at a surface of the resistive heating element to cause optimal nucleation of ink that is adjacent the surface of the resistive heating element, the system comprising:

(a) storing in memory at least one heating element dimensional value that describes at least one physical dimension of the resistive heating element;

(b) storing in memory at least one heating element electrical value that describes at least one electrical characteristic of the resistive heating element;

(c) storing in memory an expression that provides a mathematical relationship between the at least one heating element dimensional value, the at least one heating element electrical value, and a current value representing an optimum amplitude of electrical current flowing through the heating element to generate the optimum energy pulse;

(d) retrieving from memory the at least one heating element dimensional value, the at least one heating element electrical value, and the at least one expression;

(e) determining, based on the at least one expression, the current value representing the optimum amplitude of electrical current flowing through the heating element to generate the optimum energy pulse;

(f) generating the optimum energy pulse corresponding to the value determined in step (e); and (g) providing the optimum energy pulse to the heating element.

2. The system of claim 1 further comprising:

(h) step (b) including storing a heating element power density value and a heating element resistivity value;

(i) step (c) including storing the expression providing a mathematical relationship between the at least one heating element dimensional value, the heating element power density value, the heating element resistivity value, and the current value representing the optimum amplitude of electrical current flowing through the heating element; and (j) step (d) including retrieving the heating element power density value and the heating element resistivity value from memory.

3. The system of claim 2 further comprising:

(k) step (a) including storing in memory a heating element width value;

(l) step (i) including storing the expression providing a mathematical relationship between the at least one heating element width value, the heating element power density value, the heating element resistivity value, and the current value representing the optimum amplitude of electrical current flowing through the heating element; and (m) step (d) including retrieving the heating element width value from memory.

4. The system of claim 3 wherein the expression provides:

$$i = W_{htr}\sqrt{\frac{PD}{R_s}},$$

where:

i is the current value representing the optimum amplitude of electrical current flowing through the heating element to generate the energy pulse;

$W_{htr}$ is the heating element width value;

PD is the heating element power density value; and $R_s$ is the heating element resistivity value.

5. A system for providing an optimum energy pulse to a resistive heating element covered by a protective overcoat in an ink jet print head, whereby the energy pulse provides an optimal energy density at a surface of the resistive heating element to cause optimal nucleation of ink that is adjacent the protective overcoat covering the resistive heating element, the system comprising:

(a) storing in memory at least one protective overcoat dimensional value that describes at least one physical dimension of the protective overcoat;

(b) storing in memory at least one heating element electrical value that describes at least one electrical characteristic of the resistive heating element;

(c) storing in memory at least one ink-related coefficient that relates to at least one characteristic of the ink;

(d) storing in memory an expression that provides a mathematical relationship between the at least one protective overcoat dimensional value, the at least one heating element electrical value, the at least one ink-related coefficient, and an optimum time duration of the optimum energy pulse;

(e) retrieving from memory the at least one protective overcoat dimensional value, the at least one heating element electrical value, the at least one ink-related coefficient, and the expression;

(f) determining, based on the at least one expression, the optimum time duration of the optimum energy pulse;

(g) generating the optimum energy pulse having the optimum time duration determined in step (f); and (h) providing the optimum energy pulse to the heating element.

6. The system of claim 5 further comprising:

(i) storing in memory a print head offset temperature value that describes an operating point offset temperature of the print head;

(j) step (d) including storing the expression providing a mathematical relationship between the at least one print head offset temperature value, the at least one protective overcoat dimensional value, the at least one heating element electrical value, the at least one ink-related coefficient, and the optimum time duration of the optimum energy pulse; and (k) retrieving the at least one print head offset temperature value from memory.

7. The system of claim 6 wherein the expression provides:

$$t_{op} = \frac{b_2 + b_3 h + b_4(22 + \Delta T) + \frac{b_5}{PD \times 10^{-9}}}{PD},$$

where:

$t_{op}$ is the optimum time duration of the energy pulse;

ΔT is the print head offset temperature value;

PD is the heating element power density value;

h is a protective overcoat thickness value; and $b_2$, $b_3$, $b_4$, and $b_5$ are ink-related coefficients.

8. A system for providing an optimum energy pulse to a resistive heating element covered by a protective overcoat in an ink jet print head, whereby the energy pulse provides an optimal energy density at a surface of the resistive heating element to cause optimal nucleation of ink that is adjacent the protective overcoat covering the resistive heating element, the system comprising:

(a) storing in memory a heating element width value;

(b) storing in memory a protective overcoat thickness value;

(c) storing in memory a heating element power density value and a heating element resistivity value;

(d) storing in memory at least one ink-related coefficient that relates to at least one characteristic of the ink;

(e) storing in memory a print head offset temperature value that describes an operating point offset temperature of the print head;

(f) storing in memory a first expression that provides a mathematical relationship between the heating element width value, the heating element power density value, the heating element resistivity value, and a current value representing an optimum amplitude of electrical current flowing through the heating element to generate the optimum energy pulse, according to:

$$i = W_{htr}\sqrt{\frac{PD}{R_s}},$$

where:

i is the optimum amplitude of electrical current flowing through the heating element to generate the energy pulse, $W_{htr}$ is the heating element width value, and $R_s$ is the heating element resistivity value;

(g) storing in memory a second expression which provides a mathematical relationship between the protective overcoat thickness value, the heating element power density value, the at least one ink-related coefficient, the print head offset temperature value, and an optimum time duration of the optimum energy pulse to provide the optimal energy density at the surface of the resistive heating element, according to:

$$t_{op} = \frac{b_2 + b_3 h + b_4(22 + \Delta T) + \frac{b_5}{PD \times 10^{-9}}}{PD},$$

where:

$t_{op}$ is the optimum time duration of the energy pulse,

ΔT is the print head offset temperature value,

PD is the heating element power density value, h is the protective overcoat thickness value, and $b_2$, $b_3$, $b_4$, and $b_5$ are ink-related coefficients;

(h) retrieving from memory the heating element width value, the protective overcoat thickness value, the heating element power density value, the heating element resistivity value, the at least one ink-related coefficient, and the print head offset temperature value;

(i) retrieving the first expression from memory;

(j) determining, based on the first expression, the current value representing the optimum amplitude of electrical current flowing through the heating element to generate the optimum energy pulse;

(k) retrieving the second expression from memory;

(l) determining, based on the second expression, the time value representing the optimum time duration of the optimum energy pulse;

(m) generating the optimum energy pulse based on the current value determined in step (j) and having a time duration corresponding to the time value determined in step (l); and (n) providing the optimum energy pulse to the heating element.

9. An ink jet printing apparatus for forming an image on a print medium by ejecting droplets of ink onto the print medium, the apparatus comprising:

an ink jet print head having at least one resistive heating element for receiving an electrical energy pulse, for providing an energy density at a surface of the resistive heating element based on the energy pulse, and for transferring thermal energy into ink that is near the surface of the resistive heating element, thereby causing a droplet of the ink to be ejected from the print head;

a first memory module for storing at least one heating element dimensional value describing at least one physical dimension of the resistive heating elements, and at least one heating element electrical value describing at least one electrical characteristic of the resistive heating elements;

a processor for accessing the first memory module to retrieve the at least one heating element dimensional value and the at least one heating element electrical value, and for determining at least one characteristic of an optimum energy pulse to provide optimal energy density at the surface of the resistive heating element based on the at least one heating element dimensional value and the at least one heating element electrical value; and a driver circuit for selectively providing the optimum energy pulse to the resistive heating element.

10. The apparatus of claim 9 further comprising the processor for determining, based on the at least one heating element dimensional value and the at least one heating element electrical value, a current value representing an optimum amplitude of electrical current flowing through the heating element to generate the optimum energy pulse.

11. The apparatus of claim 10 further comprising:

a second memory module for storing a first expression that provides a mathematical relationship between the at least one heating element dimensional value, the at least one heating element electrical value, and the current value representing an optimum amplitude of electrical current flowing through the heating element to generate the optimum energy pulse;

the processor for accessing the second memory module to retrieve the first expression, and determining, based on the first expression, the current value representing the optimum amplitude of electrical current flowing through the heating element to generate the optimum energy pulse; and the driver circuit for selectively providing the optimum amplitude of electrical current to the heating element to generate the optimum energy pulse.

12. The apparatus of claim 10 further comprising:

the first memory module for storing a heating element power density value and a heating element resistivity value; and the processor for accessing the first memory module to retrieve the heating element power density value, the heating element resistivity value, and the at least one heating element dimensional value, and for determining the current value representing the optimum amplitude of electrical current flowing through the heating element to generate the optimum energy pulse based at least in part on the heating element power density value, the heating element resistivity value, and the at least one heating element dimensional value.

13. The apparatus of claim 11 further comprising:

the first memory module for storing a heating element power density value, a heating element resistivity value, and a heating element width value;

the second memory module for storing the first expression:

$$i = W_{htr}\sqrt{\frac{PD}{R_s}},$$

where:

i is the current value representing the optimum amplitude of electrical current flowing through the heating element to generate the optimum energy pulse, $W_{htr}$ is the heating element width value, PD is the heating element power density value, and $R_s$ is the heating element resistivity value; and the processor for retrieving the heating element power density value, the heating element width value, and the heating element resistivity value from the first memory module, for retrieving the first expression from the second memory module, and for determining the current value representing the optimum amplitude of electrical current flowing through the heating element based on the first expression.

14. The apparatus of claim 9 further comprising:

a third memory module for storing at least one ink-type identifier that identifies a type of the ink; and the processor for accessing the third memory module to retrieve the ink-type identifier, and for determining an optimum time duration of the energy pulse to provide optimal energy density at the surface of the resistive heating element based at least in part on the ink-type identifier.

15. The apparatus of claim 9 further comprising:

the first memory module for storing a heating element power density value; and the processor for accessing the first memory module to retrieve the heating element power density value, and for determining an optimum time duration of the optimum energy pulse based at least in part on the heating element power density value.

16. The apparatus of claim 9 further comprising:

a third memory module for storing a print head offset temperature value; and the processor for accessing the third memory module to retrieve the print head offset temperature value, and for determining an optimum time duration of the optimum energy pulse based at least in part on the print head offset temperature value.

17. The apparatus of claim 9 further comprising:

the at least one heating element covered by a protective overcoat;

the first memory module further for storing a protective overcoat thickness value; and the processor for accessing the first memory module to retrieve the protective overcoat thickness value, and for determining an optimum time duration of the optimum energy pulse based at least in part on the protective overcoat thickness value.

18. The apparatus of claim 9 further comprising:

the at least one heating element covered by a protective overcoat;

the first memory module further for storing at least one protective overcoat dimensional value and at least one ink-related coefficient relating to at least one characteristic of the ink;

a second memory module for storing a second expression that provides a mathematical relationship between the at least one protective overcoat dimensional value, the at least one heating element electrical value, the at least one ink-related coefficient, and a value representing an optimum time duration of the optimum energy pulse to provide the optimal energy density at the surface of the resistive heating element; and the processor for accessing the second memory module to retrieve the second expression, and determining the value representing the optimum time duration of the optimum energy pulse based thereon.

19. The apparatus of claim 18 further comprising:

the first memory module for storing a heating element power density value, a protective overcoat thickness value, and at least four ink-related coefficients relating to characteristics of the ink;

a third memory module for storing a print head offset temperature value;

the second memory module for storing the second expression:

$$t_{op} = \frac{b_2 + b_3 h + b_4(22 + \Delta T) + \frac{b_5}{PD \times 10^{-9}}}{PD},$$

where:

$t_{op}$ is the optimum time duration of the energy pulse, $\Delta T$ is the print head offset temperature value, PD is the heating element power density value, h is the protective overcoat thickness value, and $b_2$, $b_3$, $b_4$, and $b_5$ are the ink-related coefficients; and the processor for retrieving the heating element power density value, the protective overcoat thickness value, and the at least four ink-related coefficients from the first memory module, for retrieving the print head offset temperature value from the third memory module, for retrieving the second expression from the second memory module, and for determining the optimum time duration of the optimum energy pulse based on the second expression.

20. The apparatus of claim 9 wherein the first memory module is disposed on the ink jet print head.

21. The apparatus of claim 9 wherein the third memory module is disposed on an ink reservoir.

22. The apparatus of claim 9 wherein the at least one resistive heating element is covered by a protective overcoat having a thickness determined according to:

$$h = \frac{1}{b_3}\left\{\frac{b_1 R_s \Delta T}{R_x W_{htr}^2 + R_s L_{htr} W_{htr}} - \left[b_2 + b_4(22 + \Delta T) + \frac{b_5}{PD \times 10^{-9}}\right]\right\},$$

where:

h is the thickness of the protective overcoat;

$W_{htr}$ is a width of the resistive heating element;

$L_{htr}$ is a length of the resistive heating element;

$\Delta T$ is an offset temperature of the print head;

PD is a power density on the resistive heating element;

$R_s$ is a resistivity of the resistive heating element;

$R_x$ is a resistance of a switching device associated with the resistive heating element; and $b_1$, $b_2$, $b_3$, $b_4$, and $b_5$ are ink-related coefficients.

23. A system for determining a maximum optimal thickness of a protective overcoat covering a resistive heating element to which an energy pulse is provided to create an optimal energy density at a surface of the resistive heating element, thereby causing optimal nucleation of ink that is adjacent the surface of the protective overcoat, the system implemented by a computer that includes a processor and a memory, the system comprising:

(a) inputting at least one heating element dimensional value that describes at least one physical dimension of the resistive heating element;

(b) inputting at least one heating element electrical value that describes at least one electrical characteristic of the resistive heating element;

(c) inputting at least one ink-related coefficient that relates to at least one characteristic of the ink;

(d) inputting at least one print head thermal value that relates to a thermal characteristic of the print head;

(e) retrieving from the memory an expression that provides a mathematical relationship between the at least one heating element dimensional value, the at least one heating element electrical value, the at least one ink-related coefficient, the at least one thermal value, and the maximum optimal thickness of the protective overcoat; and (f) determining, based on the expression, a thickness value representing the maximum optimal thickness of the protective overcoat.

24. The system of claim 23 further comprising:

(g) inputting at least one switching device electrical value that describes at least one electrical characteristic of a switching device associated with the heating element; and (h) step (e) including retrieving from memory the expression that provides a mathematical relationship between the at least one heating element dimensional value, the at least one heating element electrical value, the at least one ink-related coefficient, the at least one thermal value, the at least one switching device electrical value, and the maximum optimal thickness of the protective overcoat.

25. The system of claim 24 further comprising:

(i) step (a) including inputting a heating element width value and a heating element length value;

(i) step (b) including inputting a heating element power density value and a heating element resistivity value;

(k) step (d) including inputting a print head offset temperature value; and (l) step (e) including retrieving from memory the expression providing a mathematical relationship between the heating element width value, the heating element length value, the heating element power density value, the heating element resistivity value, the at least one ink-related coefficient, the print head offset temperature value, the at least one switching device electrical value, and the maximum optimal thickness of the protective overcoat.

26. The system of claim 25 wherein the expression provides:

$$h_{max} = \frac{1}{b_3}\left\{\frac{b_1 R_s \Delta T}{R_x W_{htr}^2 + R_s L_{htr} W_{htr}} - \left[b_2 + b_4(22 + \Delta T) + \frac{b_5}{PD \times 10^{-9}}\right]\right\},$$

where:

$h_{max}$ is the maximum optimal thickness of the protective overcoat;

$W_{htr}$ is the heating element width value;

$L_{htr}$ is the heating element length value;

$\Delta T$ is the print head offset temperature value;

PD is the heating element power density value;

$R_s$ is the heating element resistivity value;

$R_x$ is a switching device resistance value; and $b_1$, $b_2$, $b_3$, $b_4$, and $b_5$ are ink-related coefficients.

* * * * *

UNITED STATES PATENT AND TRADEMARK OFFICE

CERTIFICATE OF CORRECTION

PATENT NO. : 6,467,864 B1
DATED : October 22, 2002
INVENTOR(S) : Robert Wilson Cornell It is certified that error appears in the above-identified patent and that said Letters Patent is hereby corrected as shown below:

Column 6,
Line 15, "Fig. 1" should be changed to -- Fig. 3 --

Column 10,
Line 32, "Table I" should be changed to -- Table II --

Column 16,
Lines 42 and 45, "elements" should be changed to -- element --

Column 19,
Line 8, "claim 9" should be changed to -- Claim 19 --

Signed and Sealed this

Third Day of June, 2003

JAMES E. ROGAN
*Director of the United States Patent and Trademark Office*